US006891339B2

(12) United States Patent
Ribarich et al.

(10) Patent No.: US 6,891,339 B2
(45) Date of Patent: May 10, 2005

(54) ADAPTIVE CFL CONTROL CIRCUIT

(75) Inventors: Thomas J. Ribarich, Laguna Beach, CA (US); Dana Wilhelm, Temple City, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/664,676

(22) Filed: Sep. 18, 2003

(65) Prior Publication Data

US 2004/0113570 A1 Jun. 17, 2004

Related U.S. Application Data

(60) Provisional application No. 60/412,621, filed on Sep. 19, 2002.

(51) Int. Cl.[7] ..... G05F 1/00

(52) U.S. Cl. ..... 315/291; 315/224; 315/209 R

(58) Field of Search ..... 315/291, 307, 315/224, 225, 209 R, 246, 247

(56) References Cited

U.S. PATENT DOCUMENTS 5,615,093 A * 3/1997 Nalbant ..... 363/25
2003/0006720 A1 1/2003 Borella et al.

* cited by examiner

*Primary Examiner*—Tuyet Thi Vo
(74) *Attorney, Agent, or Firm*—Ostrolenk, Faber, Gerb & Soffen, LLP

(57) ABSTRACT

An electronic ballast provides fault detection and safety features for overcurrent protection and hard switching at a half bridge. A voltage controlled oscillator supplies a switching frequency that is modifiable based on operational feedback parameters. A feedback circuit senses load current and output voltage to determiner fault conditions and to provide control information for adaptively adjusting the frequency of the voltage controlled oscillator. By appropriately controlling the voltage controlled oscillator output, the electronic ballast maintains a zero volt switching with minimum current switching to achieve an efficient and robust electronic ballast control. The entire control is integrated on a single integrated circuit.

24 Claims, 11 Drawing Sheets

ADAPTIVE CFL CONTROL CIRCUIT

RELATED APPLICATIONS

The present application is based on and claims benefit of U.S. Provisional Application No. 60/412,621, filed Sep. 19, 2002, entitled Adaptive CFL Control IC, to which a claim of priority is hereby made. The present application is also related to U.S. application Ser. No. 10/616,173 filed on Jul. 8, 2003, entitled Adaptive Ballast Control IC.

BACKGROUND OF THE INVENTION

1. Field of the Invention

The present invention relates generally to ballasts for compact fluorescent lamps, and relates more particularly an adaptive ballast control for a compact fluorescent lamp in an integrated circuit.

2. Description of Related Art

Electronic ballasts for fluorescent lighting applications are widely available and include integrated circuits that perform standard functions, application specific integrated circuits that provide additional functionality and micro controllers that permit programmable control of fluorescent lamps. The functions performed by these controllers often include power factor correction and lamp and/or ballast control. These types of controllers can be provided in small packages and often contribute to meeting technical requirements in newly developed fluorescent lamps while reducing the number of components in the electronic ballast, and consequently achieve a reduction in costs. A lamp type that has recently gained in popularity is a compact fluorescent lamp or CFL, which typically includes a ballast with the lamp structure, rather than separately provided from the lamp. In a typical CFL electronic ballast, the circuit with self oscillating bipolar transistors is provided to achieve the design goals of low cost, low component count and smaller package size. The self oscillating bipolar transistor design is often preferred for a number of applications involving CFLs.

However, the self oscillating bipolar transistor solution suffers from a number of drawbacks that can complicate the use of the design with a number of desired applications. For example, the bipolar design is not self starting, but rather requires a diac and additional circuitry to start the lamp. Rather than obtaining an equivalent free wheeling diode in a body of a MOSgated transistor, for example, the bipolar transistors use additional free wheeling diodes connected across an emitter and a common terminal, adding to the part count and cost. The operating frequency of the bipolar design is determined by the bipolar transistor charge storage time and the saturation of a toroid typically used with the ballast. In addition, preheat used for starting a CFL is provided by a thermistor that is somewhat unreliable and "always hot" with a positive temperature coefficient (PTC) in the bipolar design. The bipolar design also does not provide a feature for smoothly ramping up a circuit frequency during ignition, which would otherwise be useful to prevent wear on components that can occur during ignition with the bipolar solution.

Typically, the bipolar solution does not permit fault detection and responsiveness, especially in the case of a non-starting lamp, or an open filament in the lamp. The bipolar solution also has a drawback that it operates in a capacitive mode, which does not achieve the highest efficiency available. Furthermore, the bipolar solution is limited to lower power applications, due to base drive limitations that prevents its use with higher power applications.

The above mentioned drawbacks, while not presenting a major issue for a given application in and of themselves, tend to produce design difficulties in practice. When taken together, these drawbacks can produce failures and problematic operation, including a high susceptibility to component and load tolerances. Problems with the lamp or ballast components can result in catastrophic failure of the ballast output stage components, especially with regard to lack of tolerance for faults or circuit operation that is out of conformance with specifications. Because the bipolar solution lacks resilience with regard to fault handling, and has a higher component count, performance in practice can be poor for certain applications, resulting in a poor quality system or field failures. Accordingly, there is a need for a CFL electronic ballast that overcomes the drawbacks of the prior art.

SUMMARY OF THE INVENTION

In accordance with the present invention, there is a provided a simple low cost integrated control circuit that provides programmable CFL functional control, in addition to driving a half bridge composed of MOSgated switches to obtain a robust electronic ballast for a CFL. The integrated control circuit according to the present invention is simplified to minimize packaging costs and to fit into a standard integrated circuit package. For example, the integrated control circuit is provided on a chip with eight pins that handle all electronic ballast functions. Four pins are provided to drive a MOSgated half bridge, with two pins set aside for power and a circuit common. The remaining two pins program the electronic ballast minimum frequency and all other functions including preheat operation, lamp ignition and normal operation, as well as a number of fault protection functions. The programmable inputs to the integrated control circuit are coupled to an adaptive control system with a half bridge voltage sensor to accomplish the variety of CFL safety features and functionality.

For example, the adaptive control operates the electronic ballast at a frequency that is close to the resonance frequency of the electronic ballast output stage, while maintaining zero voltage switching (ZVS) in the MOSgated half bridge. Because the output current is nearly in phase with the output voltage, minimum current switching at the MOSgated half bridge is achieved.

The adaptive control uses a voltage controlled oscillator (VCO) to adjust switching frequency of the half bridge switches. The VCO also adjusts switching frequency during start up and ignition to provide smoother starting and ignition operation without producing excessive wear on the electronic ballast components. The adaptive control operates to automatically switch the half bridge for start up operation to provide a self starting feature and smooth frequency ramping during ignition. Because the adaptive integrated control circuit drives a MOSgated half bridge, there is no need for additional free wheeling diodes across the half bridge switches. In addition, the operating frequency is not limited to the switching and passive component characteristics, and reliable filament preheating is obtained without the use of additional components.

The integrated control circuit provides a number of protections against factors related to circuit failure, including an undervoltage lockout, a non-ignition condition, excessive current (short) and an open filament fault. Excessive currents can occur during ignition if the lamp does not ignite. In addition, the resonant inductor may saturate resulting in a non-ignition lamp failure. The adaptive electronic ballast control performs a crest factor measurement to determine current supplied by the switching half bridge and enters a fault mode in which the half bridge switching driver outputs are disabled if excessive current is sensed. The crest factor measurement provides a relative current measurement that is independent of temperature and tolerance variations of the RDSON value of the low side half bridge switch. Accordingly, a more accurate current sense can be obtained than in the case when the RDSON voltage of the low side MOSFET alone is used as a current sensor. The adaptive electronic ballast control provides a lockout reset feature after detection of a fault, so that power to the electronic ballast circuit must be cycled and returned to acceptable levels before the electronic ballast is permitted to operate.

BRIEF DESCRIPTION OF THE DRAWINGS

The present invention is described in greater detail below with reference to the accompanying drawings, in which.

DETAILED DESCRIPTION OF THE PREFERRED EMBODIMENTS

Figure 1:
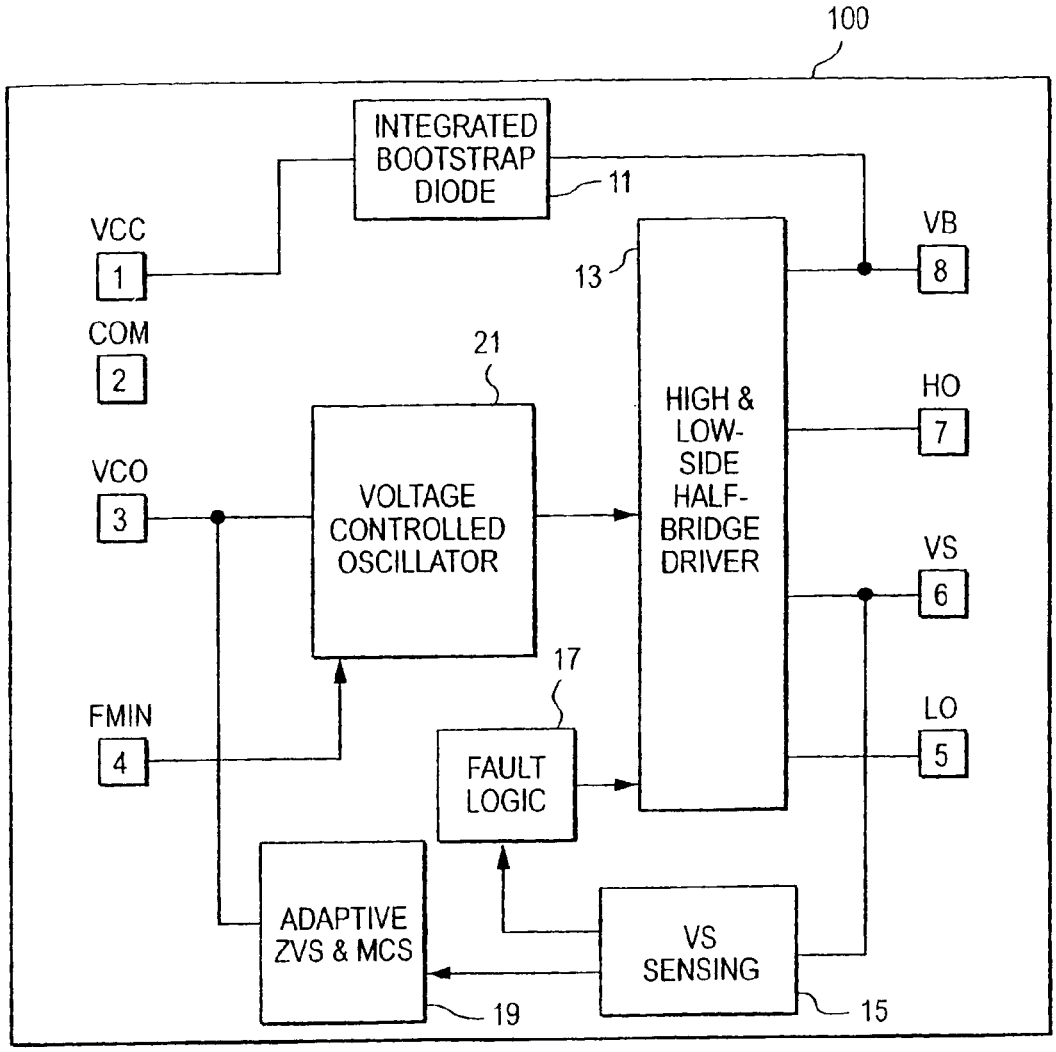
FIG. 1 is a block diagram of the integrated control circuit according to the present invention.

Referring now to FIG. 1, a block diagram of an integrated control circuit 100 according to the present invention is illustrated. Control circuit 100 includes indications of pinouts for an integrated circuit, or chip, designated by boxes numbered 1–8. Each pin number 1–8 is labeled with a descriptive term indicative of the functionality of the pin. Accordingly, pin 1 and pin 2 are labeled VCC and COM, respectively, to indicate power and ground for integrated control circuit 100. Pins 5–8 are labeled LO, VS, HO, and VB, respectively, which labels refer to typical connections for a half bridge driver. That is, pins 5 and 7 labeled LO and HO are responsible for providing the gate signals to the low and high half bridge power switches, respectively. Pins 6 and 8 labeled VS and VB represent the power supplied to the low and high side switches, respectively. In a typical half bridge configuration, the two half bridge switches are tied together at a node supplied by VS on pin 6, while the high side switch is supplied by bus voltage, and the low side switch is coupled to a common voltage provided on pin 2.

Figure 2:
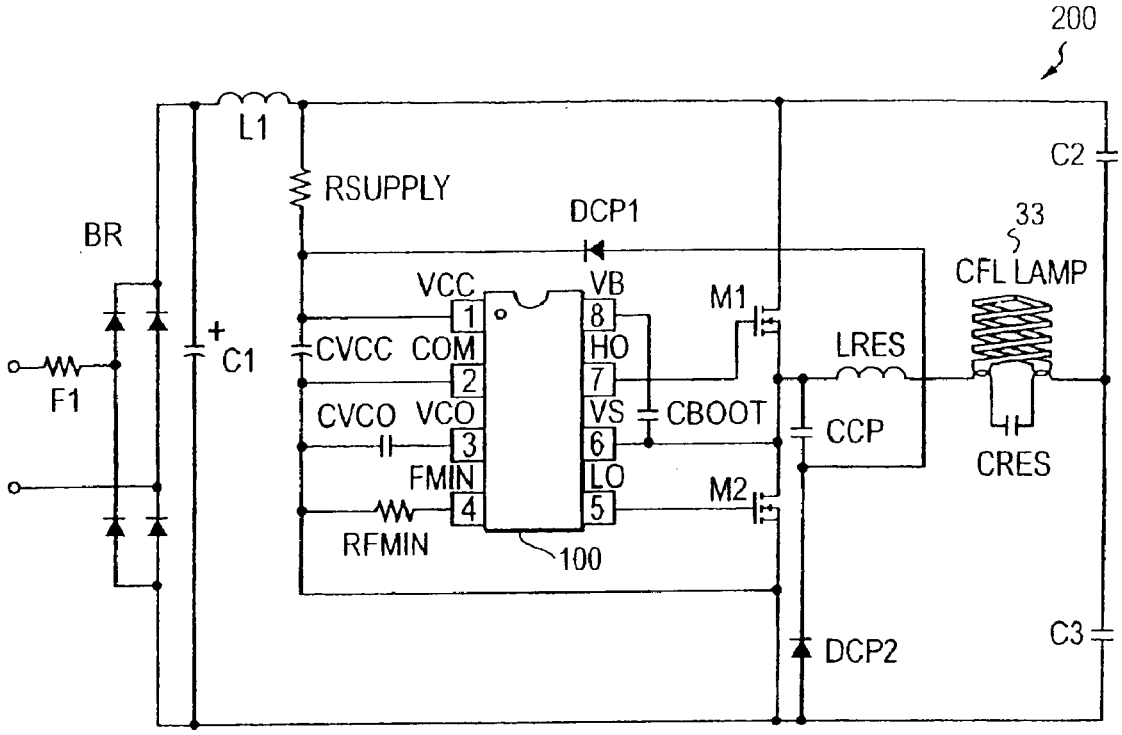
FIG. 2 is a circuit diagram for an electronic ballast using the integrated control circuit of FIG. 1.

Integrated control circuit 100 includes an integrated bootstrap diode between Vcc and Vb on pins 1 and 8 that contributes to determining the supply voltage for the high side driver circuitry, in conjunction with external supply capacitor CBOOT (FIG. 2). Circuit 100 also includes a voltage controlled oscillator (VCO) 21 that performs a number of functions in the electronic ballast control. An external signal is supplied to VCO 21 on pin 3 of circuit 100, while an external value for a minimum oscillator frequency is provided on pin 4 of circuit 100. VCO 21 contributes to changing the switching frequency of the half bridge during various operational profiles including start up mode, run mode and fault mode. The frequency of VCO 21 is influenced by an adaptive feedback control loop derived through a VS sense 15 and an adaptive zero voltage and minimum current switching control 19. Switching control 19 provides a frequency adjustment to influence half bridge switching through a half bridge driver 13 controlled by VCO 21. Switching control 19 influences the frequency of VCO 21 based on VS sense 15 to obtain zero volt switching and minimum current switching in the driven half bridge. VCO 21 is programmably limited to a minimum frequency by settings supplied through pin 4, as described in greater detail below.

Referring now to FIG. 2, a circuit diagram of a CFL lamp 33 with an electronic ballast 200 is illustrated. Control circuit 100 is illustrated as a packaged semiconductor chip with 8 pins. Control circuit 100 drives a half bridge composed of switches M1 and M2 to supply power to CFL lamp 33. A high side half bridge switch M1 is connected to the DC bus, supplied on one end of inductor L1, which receives the full wave rectified and filtered power signal from bridge BR and capacitor C1. The half bridge composed of switches M1 and M2 supply high frequency power to lamp 33 through a resonant circuit composed of inductor LRES and capacitor CRES. The combination of inductor LRES and capacitor CRES create a resonant circuit with a resonant frequency that drives lamp 33 with high efficiency. The adaptive control seeks to drive switches M1 and M2 at a frequency that approaches the resonant frequency of the resonant circuit composed of inductor LRES and capacitor CRES. As the switching frequency approaches the resonant frequency, minimum current switching can take place because the half bridge output current is almost in phase with the half bridge output voltage. By operating the half bridge in this mode, switching losses in the half bridge switches M1 and M2 are minimized.

Figure 3:
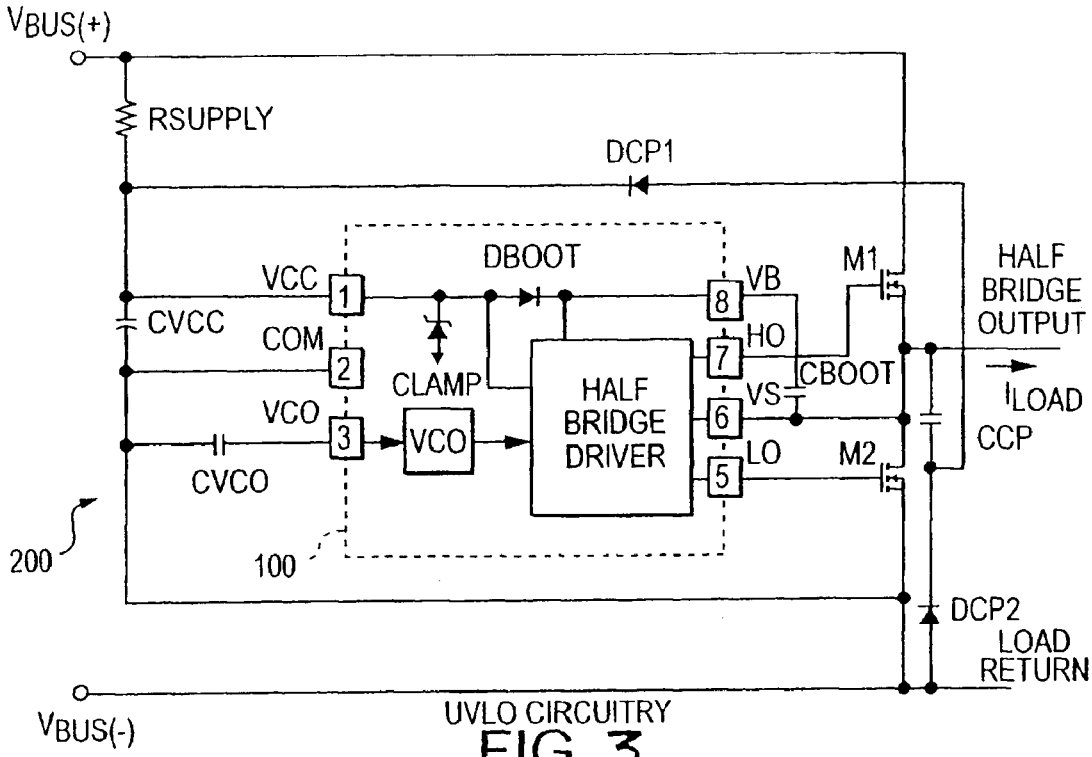
FIG. 3 is a circuit block diagram illustrating circuit connectivity in an undervoltage mode.

Referring now to FIG. 3, an illustration of the operation of the adaptive control in undervoltage lockout mode is shown. Undervoltage lockout mode (UVLO) is entered when supply voltage VCC falls below the turn on threshold of integrated control circuit 100. UVLO mode maintains an ultra low supply current, i.e., <200 $\mu$a, which permits control circuit 100 to be fully functional before the half bridge drivers, both high and low sides, are activated. A start up capacitor CVCC charges with current supplied by VBUS through resistor RSUPPLY, minus the start up current drawn by control circuit 100. Resistor RSUPPLY is chosen to provide sufficient current to supply control circuit 100 from the bus voltage VBUS. Capacitor CVCC is large enough to maintain a voltage for VCC above a threshold for UVLO mode for at least one half cycle of the input line voltage. Capacitor CVCC maintains the DC voltage on VCC and charges during peak input voltage supplied by VBUS. When the voltage on capacitor CVCC supplied to VCC reaches a start up threshold, control circuit 100 turns on and begins to drive outputs HO and LO to begin switching half bridge switches M1 and M2 in oscillation.

High side driver circuitry voltage provided on pin VB is determined by internal bootstrap diode DBOOT and external supply capacitor CBOOT. A charge pump circuit composed of capacitor CCP and diodes DCP1 and DCP2 supply low side driver voltage for the drive circuitry on VS. During circuit turn on, it is desirable that the high side voltage supply be charged to an appropriate value prior to turning on high side switch M1. Accordingly, to provide enough time to charge the high side supply circuitry before a first pulse is delivered on output HO, the circuit is designed to provide a first oscillating pulse on output LO from the driver circuitry.

During UVLO mode, control circuit 100 is placed in a safety mode and high and low side driver outputs HO and LO, respectively are both turned off, or tied low. In addition, line VCO on pin 3 is pulled down to the common voltage on line COM on pin 2 to reset the starting frequency of VCO 21 to a maximum value.

Figure 4:
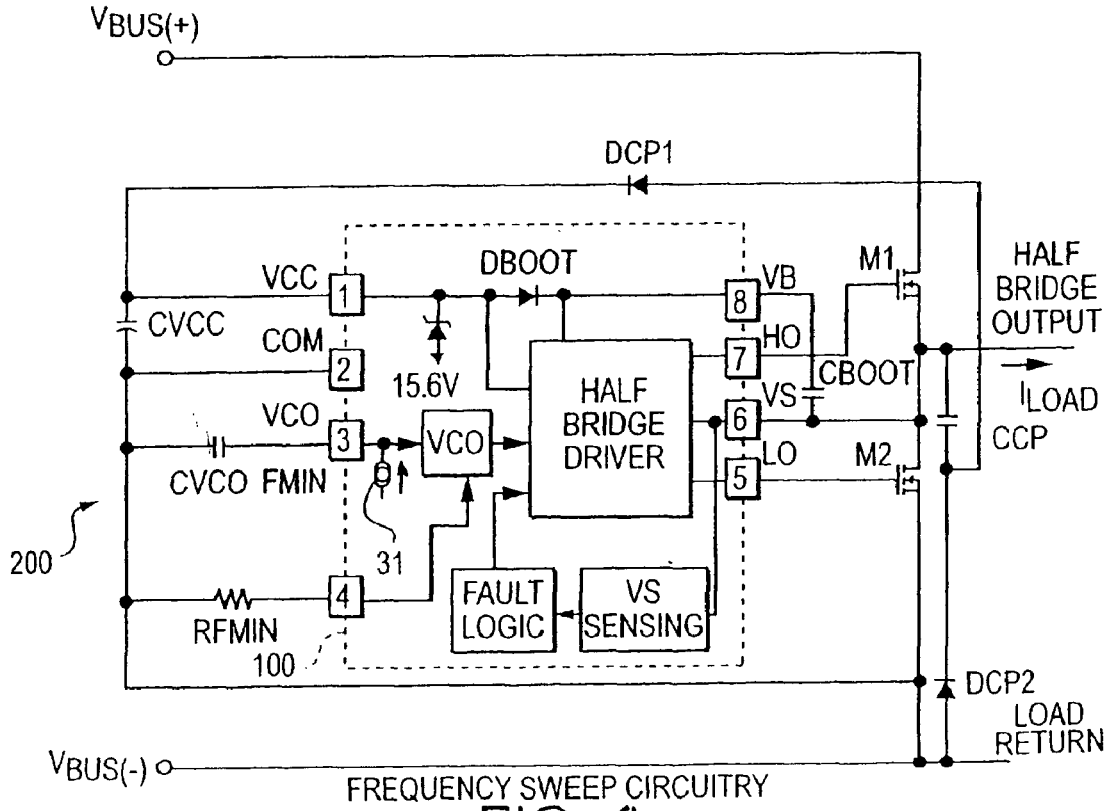
FIG. 4 is a circuit block diagram illustrating circuit connectivity in a frequency sweep mode.

Referring now to FIG. 4, a circuit block diagram of the electronic ballast according to the present invention is illustrated for frequency sweep operation. Frequency sweep mode is typically engaged when the electronic ballast starts up to power lamp 33. When VCC on pin 1 exceeds a UVLO positive threshold, control circuit 100 enters frequency sweep mode. An internal current source 31 charges an external capacitor CVCO connected on line VCO on pin 3 of control circuit 100. As capacitor CVCO charges, the voltage supplied to VCO 21 begins to ramp up exponentially. As the voltage on line VCO on pin 3 increases, the frequency of VCO 21 decreases correspondingly, ramping down towards a resonance frequency of the resonant circuit consisting of inductor LRES and capacitor CRES. The voltage on line VCO on pin 3 is initially zero, which sets the output frequency of VCO 21 to the maximum frequency. During preheat and ignition, in a frequency sweep mode, the voltage on line VCO on pin 3 ramps up with an exponential waveform shape defined by equation 1.

$$v(t)=V(1-e^{-t/RC}) \quad (1)$$

The voltage on line VCO approaches 5 volts as it ramps up, which equates to a minimum frequency, as programmed by resistor RFMIN on pin 4 of control circuit 100. The voltage on line VCO ramps exponentially due to the charge placed on external capacitors CVCO through an internal non-linear current source 31. In another preferred embodiment, the voltage on line VCO ramps up linearly as programmed by capacitor CVCO.

As the frequency of VCO 21 approaches resonance frequency of the electronic ballast output stage, and half bridge switches M1 and M2 oscillate with a frequency approaching the resonance frequency, voltage on lamp 33 and load current increase. The switching frequency continues to decrease until the output current and voltage reach a level at which lamp 33 ignites, or the output current limit is reached. If lamp 33 successfully ignites, the input voltage to VCO 21 continues to increase to reach a value of 4.6 volts. Once the input voltage to VCO 21 reaches 4.6 volts, control circuit 100 switches to adaptive run mode to maintain zero voltage and minimum current switching.

During frequency sweep mode, the switching frequency can decrease through the resonance frequency. Accordingly, the minimum frequency for VCO 21 is programmed by external resistor RFMIN on pin 4 to be lower than resonance frequency. The resonant circuit provides a high-Q resonance and a minimum switching frequency should be lower than the high-Q resonance frequency. If the input voltage to VCO 21 ramps exponentially, VCO 21 ramps quickly through the higher frequencies where the gain across the resonant output stage is low. When there is low gain for the resonant output stage, less current is available for preheating purposes. Accordingly, as VCO 21 outputs a lower frequency, more current is available for preheating to permit better response and increased component life.

The exponential shape of the input voltage to VCO 21 produces a slower ramp through lower frequencies approaching resonance. In the lower frequencies, the gain of the resonant output stage is higher and more stable. Accordingly, preheating can take place under better control with higher currents.

Preferably, the input voltage to VCO 21 ramps linearly towards the resonance frequency. As the frequency approaches resonance, the lamp typically ignites at a frequency above resonance because the gain across the resonant tank increases sharply near the resonant frequency to achieve an output voltage to ignite the lamp. Once the lamp ignites, the load becomes overdamped and the resonant frequency decreases. Because the circuit enters run mode after the lamp ignites, the output of VCO 21 typically remains above resonant frequency.

It is possible that the switching frequency can run below the resonant frequency for a number of cycles, even to the point of reaching FMIN, however, the ZVS circuit brings the frequency back up during run mode. The duration of time below resonant switching frequency is short, and should not cause any problem or damage to the circuit.

As the frequency decreases toward the high-Q resonance frequency of the output state during frequency sweep mode, the lamp filaments are preheated until the lamp voltage increases to a high enough point at which lamp 33 ignites. As noted above, the minimum frequency is programmed by an external resistor RFMIN on pin 4 of control circuit 100. A maximum frequency is set internally to a fixed margin higher than the minimum frequency to ensure that the lamp voltage is low during initial start up to prevent unwanted "flash" from occurring across the lamp. The amount of preheat and time-to-light is programmed by external capacitor CVCO.

Figure 5:
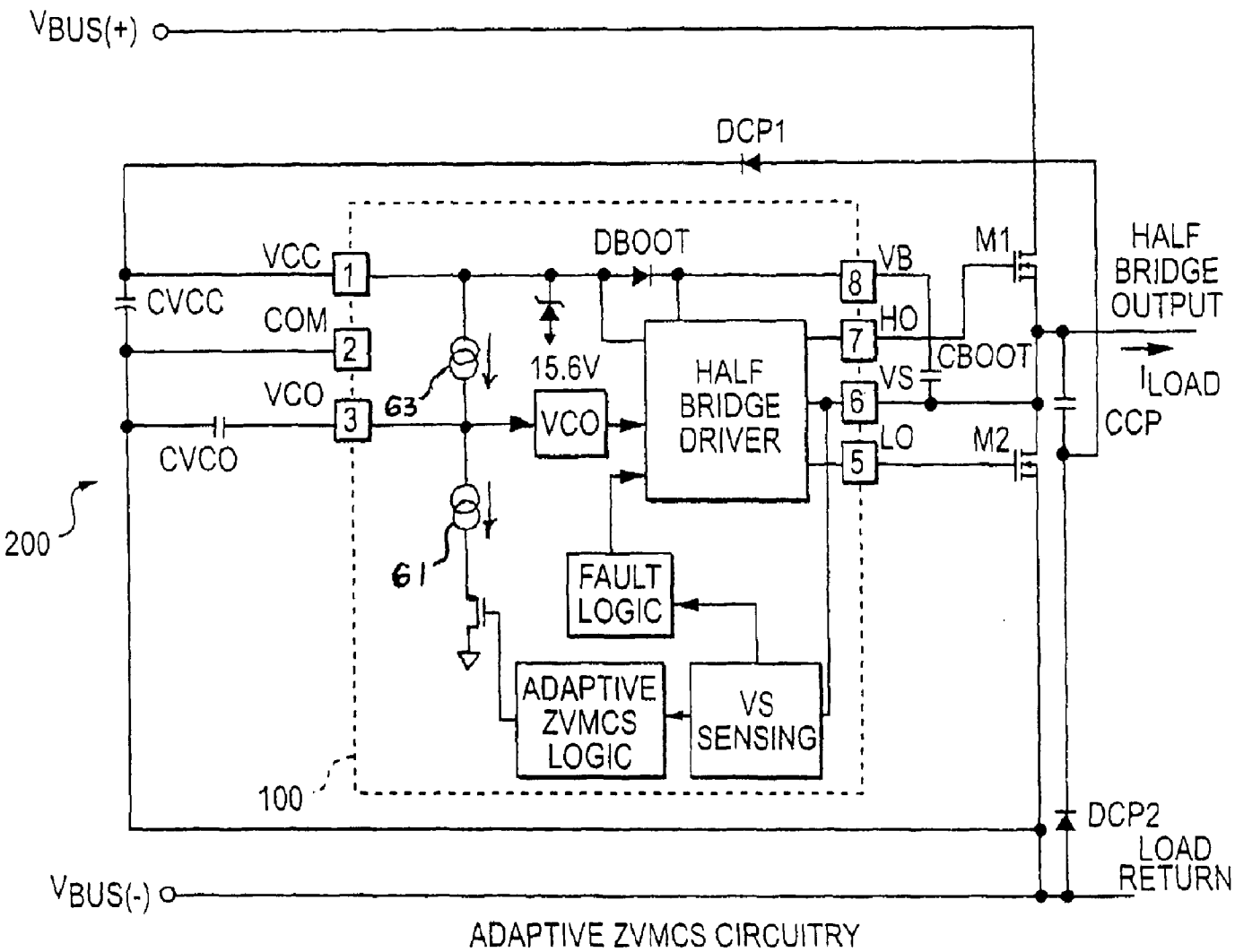
FIG. 5 is a circuit block diagram illustrating circuit connectivity during normal run mode with adaptive response.

Referring now to FIG. 5, a circuit diagram showing electronic ballast operation during adaptive run mode is illustrated. Adaptive run mode is enabled when the input voltage to VCO 21 increases above 4.6 volts. At this point, the frequency has typically swept through the resonant frequency and the lamp has ignited. When the lamp ignites, the output stage becomes a low-Q RCL circuit and the frequency adjusts to the desired operating point that is slightly above resonant frequency. According to the adaptive run mode control, the operating frequency is set as close as possible to the resonance frequency of the low-Q RCL output stage, while maintaining zero voltage switching (ZVS) at the half bridge switching stage. With the switching frequency close to the resonance frequency, the output current is nearly in phase with the half bridge output voltage, resulting in a minimum current switching (MCS). The control thus provides an adaptive run mode with ZVS and MCS that minimizes the switching losses of the half bridge switches M1 and M2.

VS sense 15 obtains feedback from half bridge driver 13 to determine output voltage and phase on line VS at pin 6. VS sense 15 is provided internally in control circuit 100 to permit good closed loop operating characteristics with high noise immunity. This closed loop control operates the half bridge at a frequency close to resonant frequency which permits the electronic ballast to operate with ZVS and MCS even with varying component and lamp tolerances that may occur through manufacturing and production steps. In addition, the closed loop control provides ZVS and MCS as the input line voltage varies, and as component tolerances change over time, for example, as the characteristics of lamp 33 may change over its lifetime.

The closed loop ZVS and MCS control is achieved by internally sensing the half bridge voltage output on line VS on pin 6 during non-overlapping deadtime for half bridge switching. During each half bridge switching cycle, half bridge voltage slews to the opposite rail during deadtime. Closed loop frequency control parameters are measured in relation to a determination of whether the voltage has slewed entirely to the opposite rail prior to turning on the appropriate switch. That is, if voltage has not slewed to the opposite rail so that there is a zero voltage across the switch that is to be turned on, the switching frequency is too close to resonance and the closed loop control shifts the frequency slightly higher. The voltage slew measurement is performed prior to the turn on of the low side switch M2, at the beginning of a small time interval of approximately 100 nanoseconds provided prior to switch turn on to permit early error detection and provide a safe margin for response. If the voltage has not slewed to zero by the time of approximately 100 nanoseconds prior to switch turn on, a pulse of current is delivered to the VCO input on pin 3 from internal current source 61. The current pulse slightly discharges external capacitor CVCO, decreasing the voltage input to VCO 21 and causing the output frequency to slightly increase. For the rest of the switching cycle, external capacitor CVCO charges slowly due to current supplied by internal current source 63. The adaptive run mode control thus adjusts the frequency slightly upward as the circuit operating frequency is driven to a lower frequency due to operational events such as changes in line voltage or load characteristics, for example. These operational events tend to produce a decreased resonance frequency that can cause non-ZVS switching. The adaptive closed loop control circuit "nudges" the frequency to a higher value that is slightly above resonance when non zero volt switching occurs. The closed loop adaptive control maintains a switching frequency near resonance in the adaptive run mode to obtain ZVS and MCS operation notwithstanding changing input line voltage and current conditions, component tolerance variations and lamp/load variations.

The fabrication process used in the development of control circuit 100 is a 600 volt fabrication process, and provides an internal high voltage transistor connected to line VS on pin 6 to accurately measure voltage, and particularly zero volts during the non-overlapping deadtime. The internal transistor also withstands high DC bus voltage during portions of the switching cycle when high side switch M1 in the half bridge is turned on, that is, when line VS is at the DC bus potential.

Control circuit 100 also includes fault protection, determined through fault logic 17 (FIG. 1). If a lamp non-ignition condition occurs when the lamp filaments are intact but the lamp does not ignite, the lamp voltage and output stage current increases during the ignition ramp to excessive amounts, as described above. When the output stage current and lamp voltage reach excessive amounts, or if the resonant inductor saturates, a fault is considered to have occurred during ignition. This state is detected by performing an internal measurement on line VS at pin 6 during the entire on time of low side switch M2. Voltage measured on line VS during the on time pulse provided on line LO is determined by the low side switch current, which indicates the output stage current. The current is measured flowing through the ON resistance of low side switch M2, that is, a voltage reading is taken across the ON resistance (RDSON) of low side switch M2. By using the internal ON resistance of low side switch M2, the half bridge current is sensed without the need of an additional external current sensing resistor, and an additional input current sensing pin in control circuit 100. The RDSON value of low side switch M2 serves as the current sensing resistor for fault detection, while line VS serves as the current sensing pin input on control circuit 100 during start up. During start up, an internal high voltage switch, as described above, is turned on when the voltage on line VS is low, i.e., low side switch M2 is ON, to permit a voltage measure to be obtained through the low side circuitry to perform the current sensing. The internal high voltage switch is turned off for the rest of the switching cycle to withstand the high voltage applied on line VS when high side switch M1 is turned on, and DC bus voltage is applied to line VS.

Because the internal ON resistance of low side switch M2 has a positive temperature coefficient, control circuit 100 performs an internal crest factor measurement to detect excessive or dangerous currents or inductor saturation, which can occur during a lamp non-ignition fault condition. Control circuit 100 performs a crest factor measurement to provide a relative current measurement that is independent of temperature and/or tolerance variations of the RDSON internal ON resistance of the low side half bridge switch M2. The crest factor of a current waveform is typically defined as the ratio of the peak current in amps to the RMS current in amps. For example, the crest factor for a typical sinusoidal 60 Hz current waveform is 1.4. The crest factor measurement therefore obtains an indication of current spikes in the output stage that can be excessive or dangerous if experienced for a certain amount of time. In a preferred embodiment of the present invention, a crest factor of 4, i.e., the peak current is four times the average current, is used to determine fault conditions.

If a peak current exceeds the average current by a factor of 4 for approximately fifty switching cycles as determined on line LO, control circuit 100 determines a fault has occurred. At that point, during the ON time of an output pulse on line LO, control circuit 100 enters fault mode and both gate drivers for lines HO and LO driver outputs are latched low. This safety condition persists until power is cycled to control circuit 100. Preferably, supply voltage VCC is recycled below and above the internal UVLO thresholds. The crest factor can be arbitrarily set to any given number depending on the application. In addition, the number of switching cycles for detecting a crest factor fault can be set to an arbitrary number depending on the application. One advantage to setting the number of switching cycles for a fault to occur before it is deemed a fault is events where inductor saturation occurs. During lamp ignition, the inductor can saturate for several cycles while the lamp arc is being established. The saturated inductor appears as a shutdown fault condition. However, control circuit 100 waits for the given number of switching cycles before determining a fault has occurred to avoid false fault detection in this situation.

A further embodiment of the crest factor detection is that it is only enabled during the on-time of LO, after a small delay (1 $\mu$s) after the rising edge of LO. Crest factor detection is disabled during the deadtime and during the on-time of HO. This is because the inductor current saturates towards the end of the LO on-time. Crest factor detection is used for inductor current saturation detection. Other fault conditions like open filament are detected by non-ZVS shifting and 1V VCO shutdown threshold. As the frequency is sweeping towards resonance for ignition during crest factor detection, the circuit obtains the maximum voltage that the inductor can deliver before it saturates. Since inductor saturation is highly dependent on temperature, the crest factor will then cause the maximum voltage delivered by the circuit to adjust automatically for tolerances based on temperature. At low temperatures, for example, the lamp requires higher ignition voltages to ignite. Since inductors saturate at higher currents at lower temperatures, the circuit produces a higher voltage before the crest factor detects saturation and shutdown. This adaptive feature thus provides higher voltages at lower temperatures when necessary. Also, if the inductor saturation level is low or a highly varying core material is used such that the saturation level is inconsistent during production, the circuit will still shutdown at saturation and therefore protect the circuit against damaging currents that can occur during saturation.

Another fault detected by control circuit 100 is an open filament lamp fault. Open filament lamp faults can cause hard switching at the half bridge and potentially damage switches M1 and M2. This type of fault is detected through the non-zero volt switching circuit or the crest factor circuit after approximately fifty switching cycles in the presence of the fault condition. The adaptive control enters a fault mode when this fault is determined, and the high and low gate driver outputs are latched low. As with the non-ignition fault, power must be cycled to control circuit 100 to remove the fault condition. Preferably, voltage supplied to VCC is cycled to be below and above the internal UVLO thresholds, resetting control circuit 100 back to a preheat mode.

Figure 6:
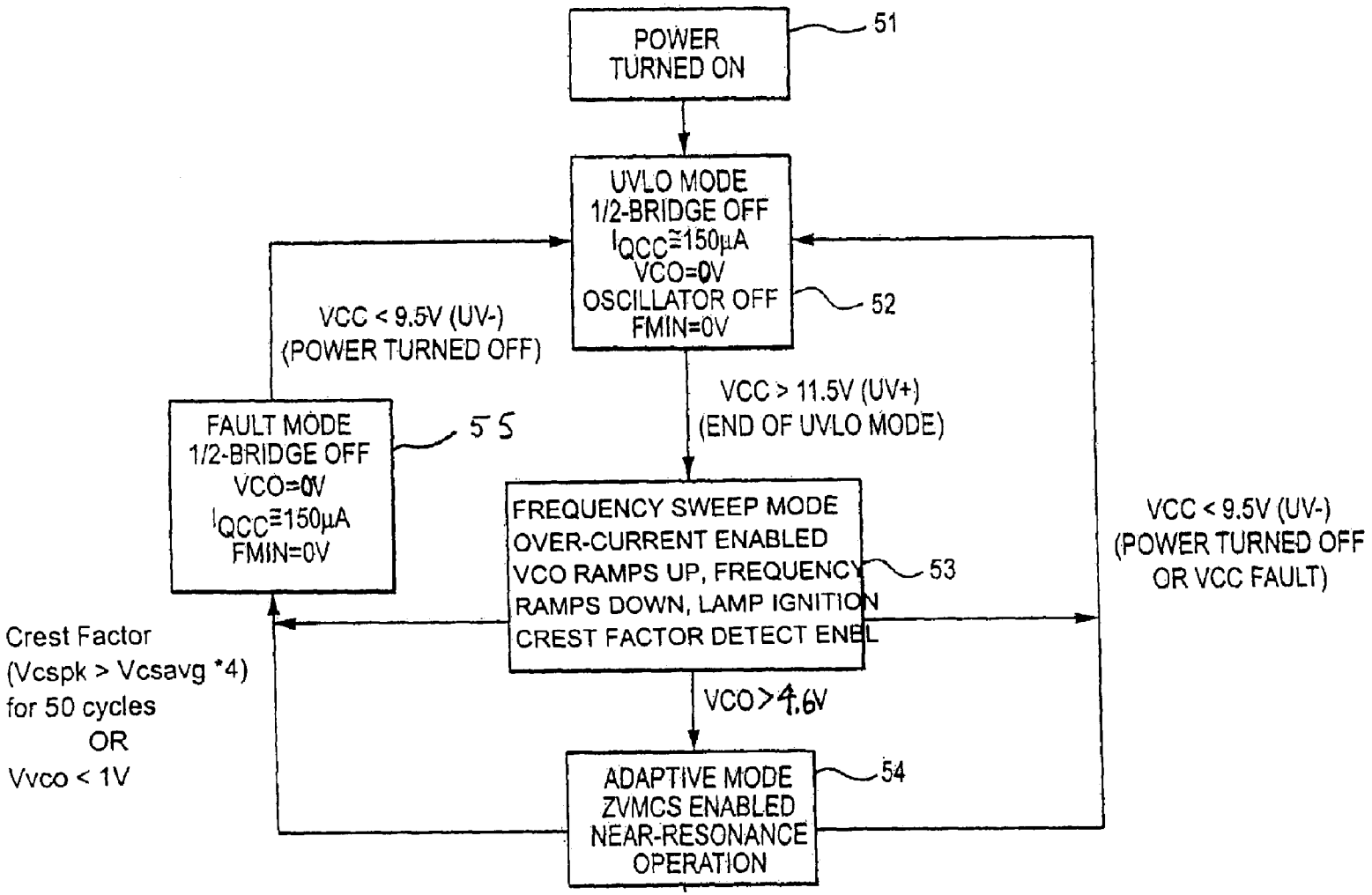
FIG. 6 is an abstract state machine illustrating operation of the present invention.

Referring now to FIG. 6, a flowchart describing operation of control circuit 100 is illustrated. After power is turned on in block 51, DC power is supplied to both rails of the DC bus. Control circuit 100 enters UVLO mode in block 52, during which the half bridge is maintained in an OFF condition while current supplied to the electronic ballast is approximately 150 $\mu$a. At this point the voltage on line VCO of pin 3 is zero volts and VCO 21 is off. Similarly, the voltage on line FMIN on pin 4 of control circuit 100 is zero volts. The state in block 52 is exited once the voltage on VCC on pin 1 is greater than 11.5 volts, which is the upper threshold level for UVLO mode. Once the state in block 52 is exited, UVLO mode ends.

At the end of UVLO mode, frequency sweep mode is entered in block 53, during which overcurrent protection is enabled and the voltage on line VCO of pin 3 begins to increase exponentially. In a preferred embodiment, the voltage on line VCO of pin 3 can increase linearly. During this state, the frequency output of VCO 21 begins to ramp down as the VCO input ramps up, leading to oscillation in the half bridge to supply current and voltage to the load to cause lamp ignition. It is during this state that preheating occurs, and maximum current is supplied to the load to permit preheating and ignition. If a fault occurs during this state, such as a lamp ignition failure, control circuit 100 enters a fault mode state in block 55 to protect the electronic ballast circuit. In addition, if an undervoltage condition occurs i.e., VCC is less than 9.5 volts, the UVLO low threshold, the state of control circuit 100 is returned to UVLO mode in block 52.

Conventional ballasts circuits remain at a fixed preheat frequency for the duration of a preheat time, and then ramp the switching frequency up quickly for ignition. The preheat method achieved by control circuit 100 preheats the filaments and ignites the lamp together in a single frequency sweep. The parameters of this method are simple to program by adjusting the value of capacitor for CVCO for adequate preheating. This novel method substantially reduces the number of IC pins and external components required for programming the preheat functions. Conventional ballast control ICs require a separate pin for setting the preheat time, a second pin for programming a higher start frequency to prevent a flash on the lamp at initial start-up of the half-bridge, a third pin for programming the preheat frequency, and a fourth pin for programming the ignition ramp time. The method according to the present invention uses a single pin and a single external component which greatly simplifies the circuit, the functionality, the system cost, the manufacturability and reduces size of the IC, the pin count, packaging requirements and final testing.

Otherwise, if the lamp ignites normally, control circuit 100 enters an adaptive mode state in block 54, with the voltage on line VCO greater than 4.6 volts. This state permits zero volt switching and minimum current switching to be enabled at near resonance operation. In the adaptive mode state in block 54, the closed loop feedback control is operative to adjust switching frequency based on the sensed voltage on line VS. Normal adaptive run mode continues indefinitely, or until either a fault is sensed or an undervoltage condition occurs. If an undervoltage occurs, i.e., VCC is less than 9.5 volts, control circuit 100 enters UVLO mode in block 52, shutting off the half bridge drivers and disabling VCO 21. In this way, if power is turned off, the half bridge and the entire electronic ballast is shut down in a controlled mode to avoid additional component wear.

If control circuit 100 is operating in adaptive mode in block 54 and a fault occurs, a fault mode state in block 55 is entered, in which the half bridge drivers are disabled and VCO 21 is shut off. This state is similar to UVLO mode, with the exception that the state in block 55 is reached upon a crest factor fault determination or non-zero volt switching for approximately fifty switching cycles of low side driver output LO. The state transition conditions from block 54 to 55 call for a peak voltage, representative of a peak current, to be greater than four times an average voltage, representative of an average current value. This determination provides a crest factor of 4 for overcurrent or inductor saturation conditions detection. In addition, control circuit 100 detects non-zero volt switching to determine whether a fault has occurred, typically resulting in hard switching at the half bridge. In each of the above fault condition cases, if the fault is detected for fifty switching cycles of low side driver output LO, a fault condition is established and control circuit 100 enters a fault mode state in block 55. The fault mode state in block 55 is maintained until power is cycled to control circuit 100, i.e., VCC is lowered to below the lower UVLO threshold of 9.5 volts, at which point control circuit 100 transitions to UVLO mode state in block 52.

Control circuit 100 detects an open load, or open filament, fault condition by detecting changes in operational conditions. During an open fault condition, control circuit 100 detects a non-ZVS condition and attempts to increase the frequency to return operation of the ballast to ZVS. In the presence of a fault condition where the load is removed where the filament is open, the voltage on line VCO on pin 3 is decreased to further increase the frequency output of VCO 21. When the voltage on line VCO on pin 3 reaches 1 volt, the maximum frequency for VCO 21 is reached. When the voltage on line VCO decreases below 1 volt, a fault condition is deemed to have occurred and control circuit 100 latches the high and low side switch control outputs HO and LO into an OFF condition. This fault condition for line VCO with a 1 volt latch off threshold is not activated until the voltage on line VCO first increases from zero volts to above 4.6 volts, i.e., after preheat and ignition. By delaying the enable of the fault condition threshold, control circuit 100 will not immediately latch off the high and low sides which control outputs HO and LO after control circuit 100 turns on.

If a fault condition occurs where a filament is open, control circuit 100 turns on and the voltage on line VCO ramps up normally from zero volts to 4.6 volts for normal preheat and ignition. Once the voltage on line VCO exceeds 4.6 volts and the control enters the adaptive run mode, non-ZVS protection is activated, in addition to the fault condition threshold of 1 volt on line VCO for latching off the half bridge outputs HO and LO. At this point, the frequency output of VCO 21 continues to increase in an attempt to maintain ZVS, until the voltage on line VCO decreases below 1 volt, and control circuit 100 safely latches off the outputs for controlling the half bridge. The time to shut down the outputs during an open filament fault condition as described above, is approximately the preheat time plus the time to discharge the voltage on line VCO to below 1 volt. The total time for these events is typically less than approximately 10 milliseconds. The events within the time frame described above provides a total shut down time that is short enough to prevent damage to the half bridge switches and the ballast circuitry.

Another feature of the present invention provided in adaptive run mode in block 54 is a frequency dither to reduce noise generated by the ballast that reduces the EMI filtering on the ballast input. When the input to VCO 21 on line VCO ramps up to 5.1 volts, the VCO line on pin 3 is discharged linearly by 200 mV to approximately 4.9 volts. When the voltage on line VCO decreases below 4.9 volts, the voltage on line VCO is then charged linearly again to 5.1 volts. This slight charging and discharging of the voltage on line VCO by approximately 200 mV occurs continuously during adaptive run mode in block 54. The charging and discharging causes the frequency to dither slightly by a few kilohertz. Consequently, the operating frequency of the half bridge also slightly dithers such that the resulting EMI disturbance peak at the operating frequency will be lower because the switching frequency becomes spread out by a few kilohertz. The resulting EMI disturbance is then lower, which then results in reduction or the possible removal of external EMI filtering on the ballast input. This component reduction or elimination obtains the advantage of better system operation with reduced cost and lower component count for the overall system.

Figure 7:
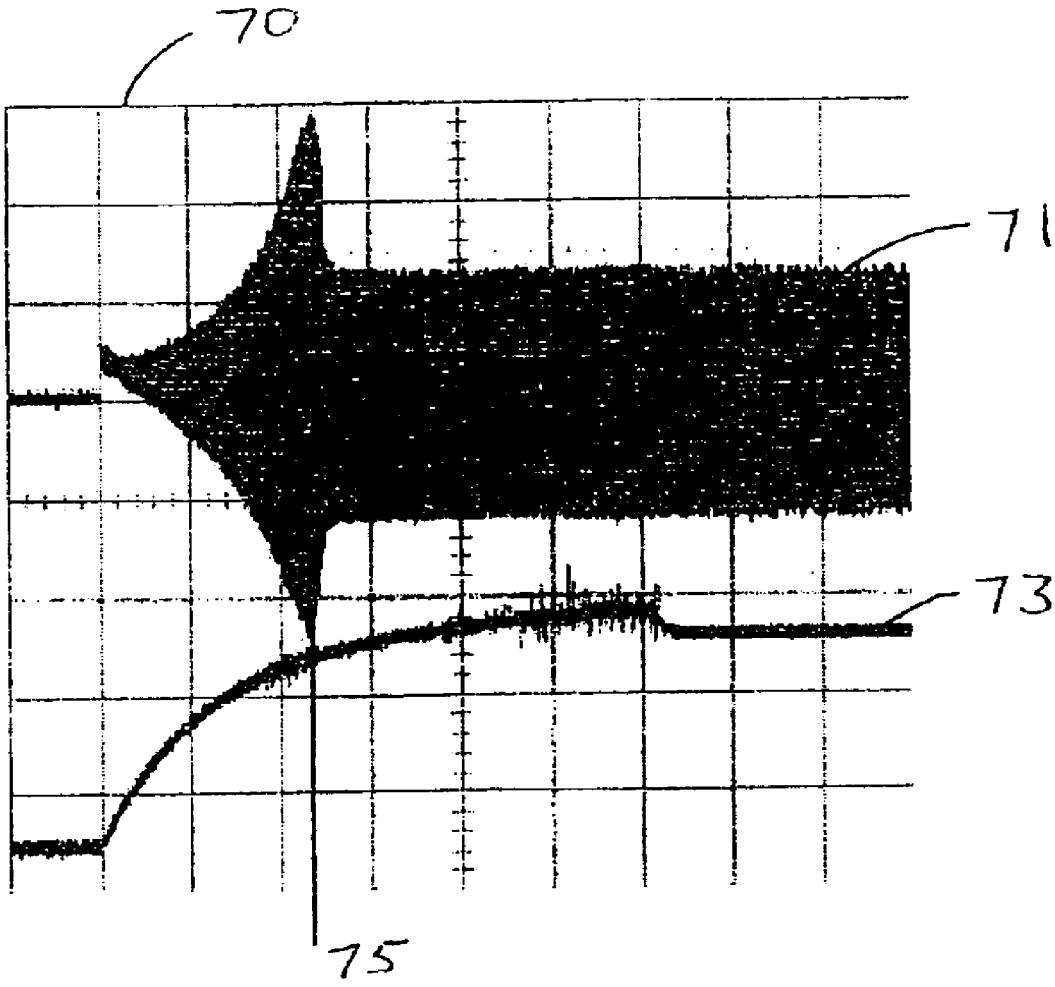
FIG. 7 is a graph illustrating circuit voltages during various modes of operation.

Referring now to FIG. 7, a graph 70 illustrating circuit voltages during start up of control circuit 100 is shown. The graph in FIG. 7 shows lamp voltage trace 71, with each division representative of 250 volts on a time scale of 200 ms, and a trace 73 showing voltage on line VCO on pin 3 of control circuit 100 with a scale of 2 volts per division and 200 ms for a time scale. As shown in graph 70, the voltage on line VCO charges exponentially so that the frequency output of VCO 21 drops quickly in the high frequency range, and decreases more slowly in a lower frequency range. In another preferred embodiment, the voltage on line VCO charges linearly. The amplitude of the voltage and current supplied to lamp 33 increases during this period up to a point 75 where ignition occurs. Prior to this point, the filaments of lamp 33 are preheated with high current supplied to the lamp for smooth ignition. At the point of ignition, once the voltage on line VCO is greater than 4.6 volts, the adaptive run mode is entered during which control circuit 100 provides control for zero volt and minimum current switching at the half bridge. The frequency of VCO 21 is maintained near resonance frequency of the resonant inductor and capacitor coupled to lamp 33. As can be seen in graph 70, the voltage trace 71 of lamp voltage during adaptive run mode begins to slowly decrease to an efficient operating level. The resulting electronic ballast operation provides a smooth and efficient control with closed loop feedback that prevents damage to components and detects potentially damaging fault conditions.

Figure 8:
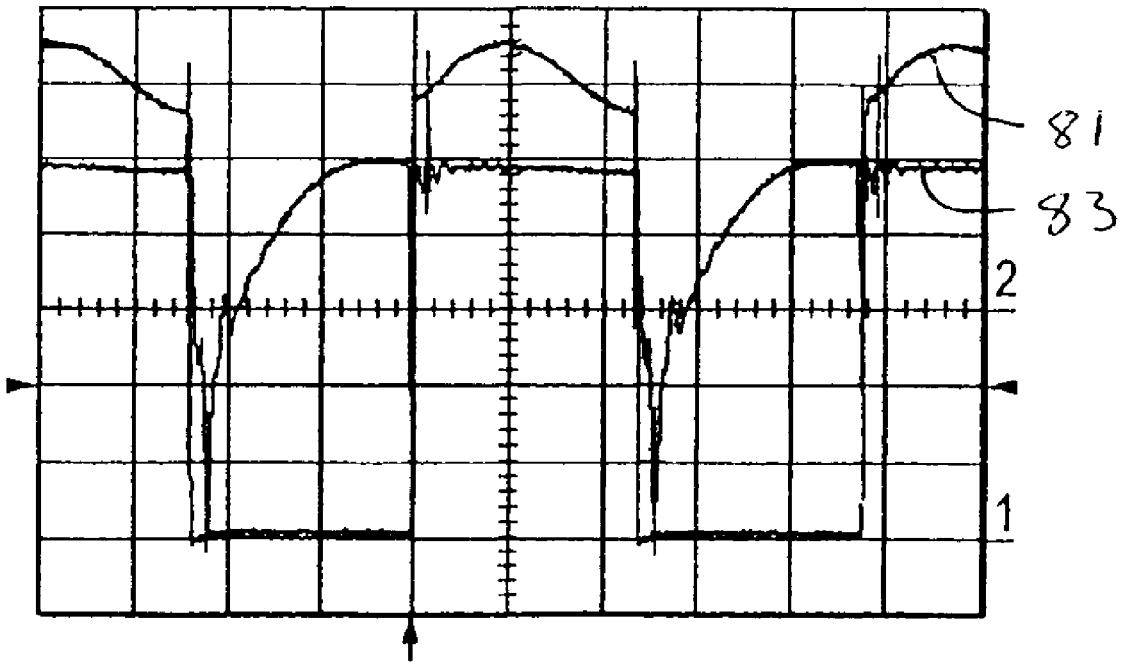
FIG. 8 is a graph showing half bridge voltage and current in a run mode according to the present invention.
Figure 9:
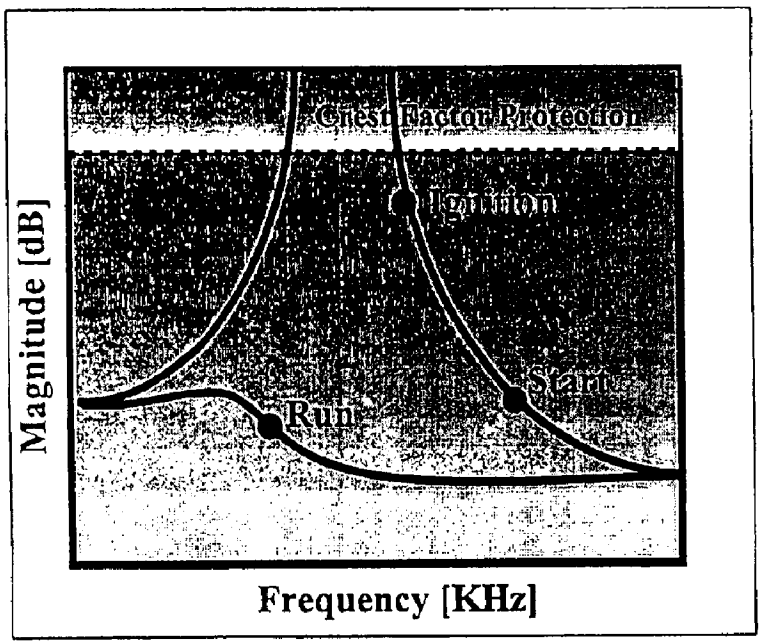
FIG. 9 is a graph showing a current control sequence.
Figure 9:
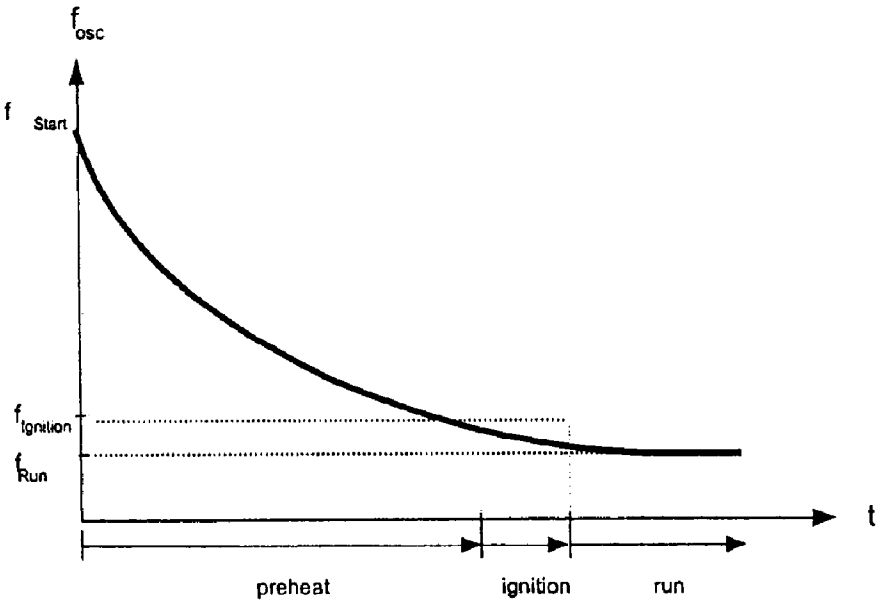
Figure 10:
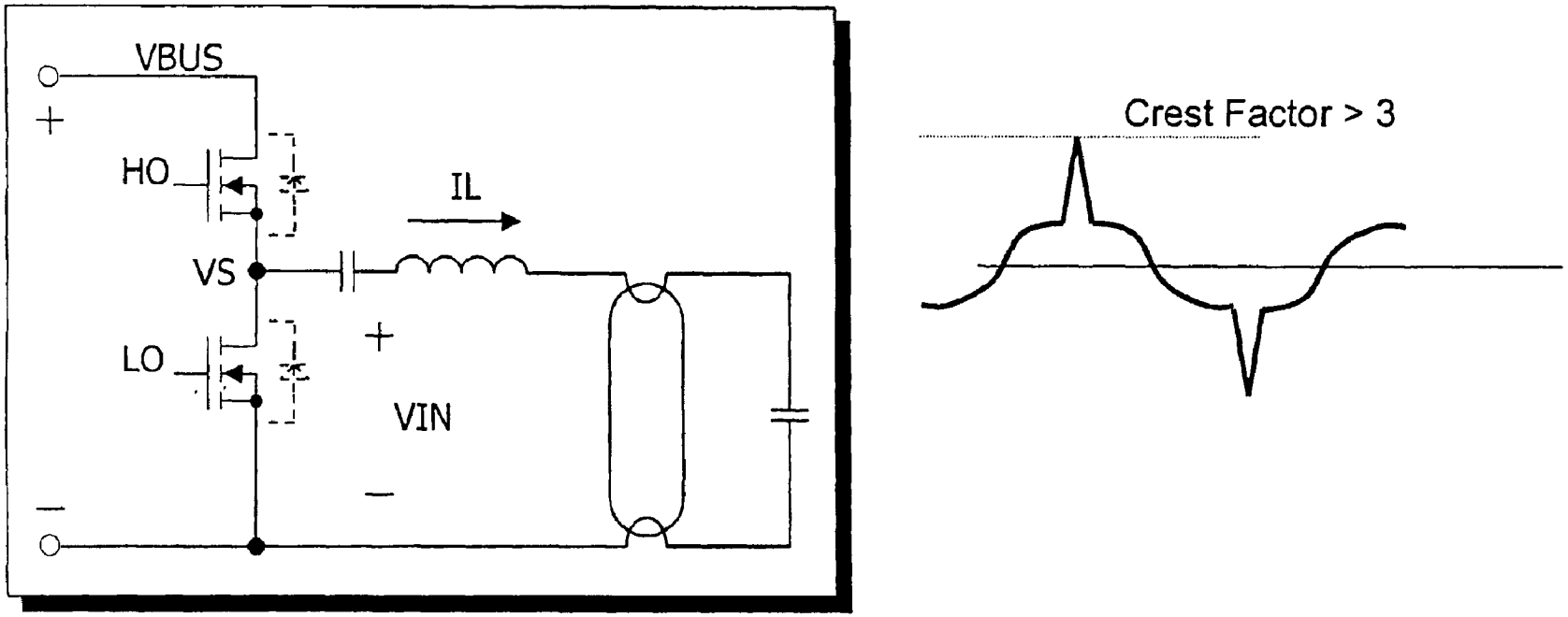
FIG. 10 is a circuit and graph illustrating fault mode crest factor determination.
Figure 11:
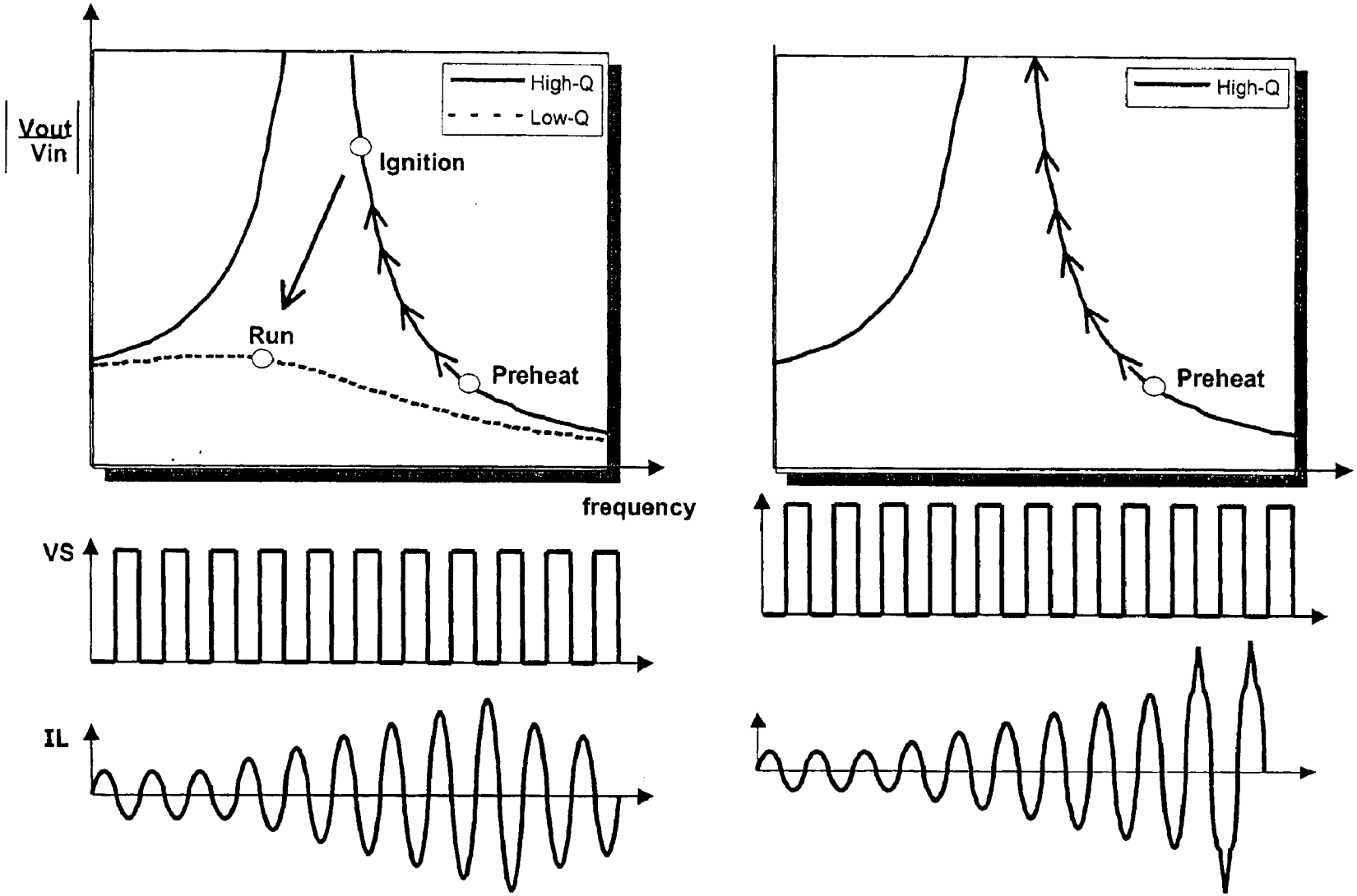
FIG. 11 shows graphs illustrating normal and fault current control sequences.
Figure 12:
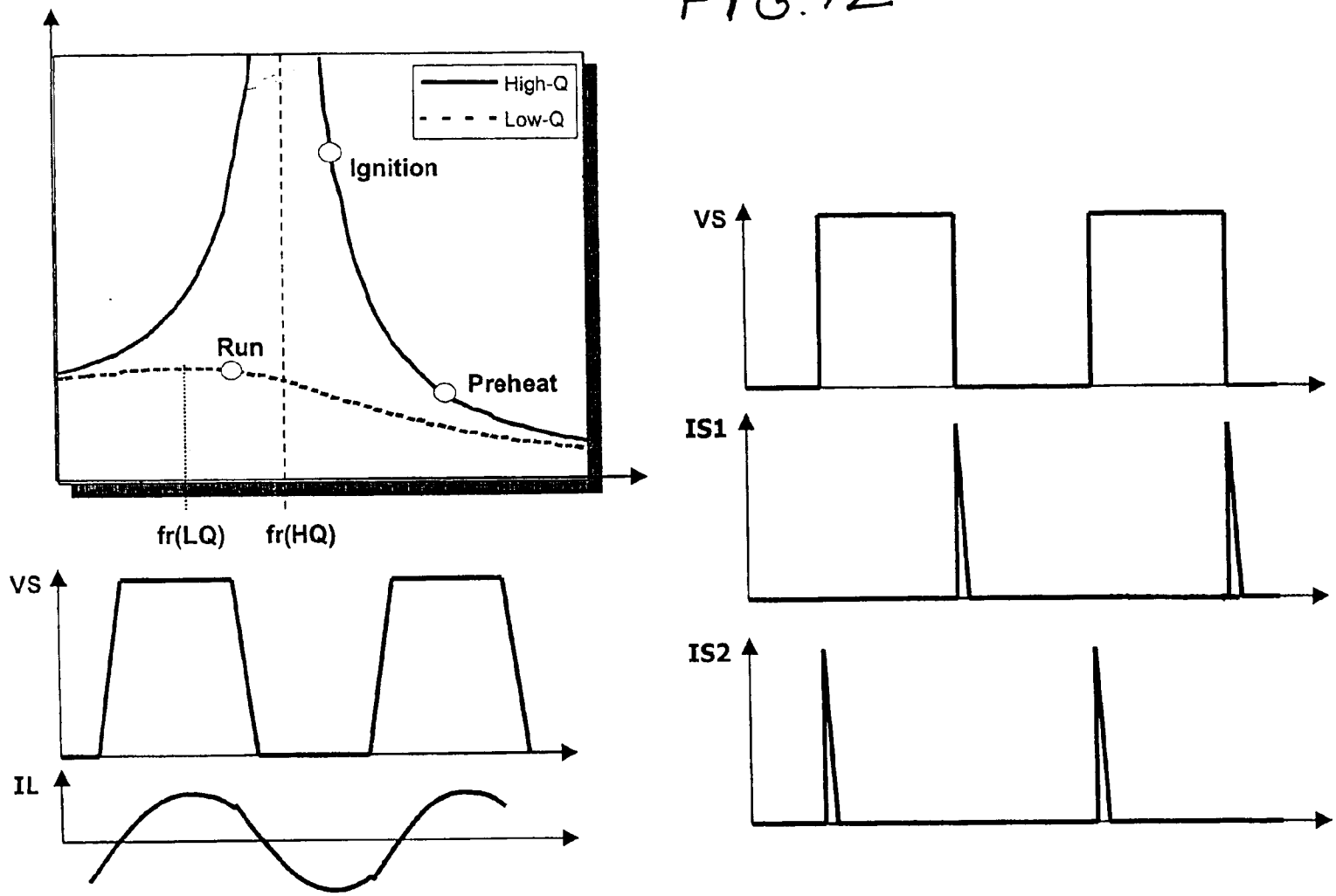
FIG. 12 shows graphs illustrating open filament fault detection.

Referring now to FIG. 8, traces 81 and 83 represent half bridge voltage VS and low side switch current in the switching half bridge, respectively. Traces 81 and 83 show voltages corresponding to operation of the half bridge during adaptive run mode. Trace 81 illustrates zero voltage switching for the low side switch, while trace 83 illustrates minimum current switching for the low side switch.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control circuit for an electronic ballast with a power switch, comprising:

a driver circuit for driving the power switch;

a switching control circuit coupled to the driver circuit for providing signals to the driver circuit for operating the power switch;

a feedback circuit coupled to the driver circuit and the control circuit for providing control information to the control circuit based on output values of the driver circuit;

a fault responsive circuit coupled to the feedback circuit and the driver circuit for responding to faults detected in the feedback circuit; and the fault response circuit is operable to disable the driver circuit upon detection of a fault.

2. The control circuit according to claim 1, wherein the switching control circuit is a voltage controlled oscillator.

3. The control circuit according to claim 1, further comprising a minimum frequency input signal supplied to the switching control circuit for providing a minimum frequency for operation of the switching control circuit.

4. The control circuit according to claim 1, further comprising a sense signal coupled to the power switch and to the feedback circuit and operable to provide a current sense by measuring a voltage across the power switch.

5. The circuit according to claim 1, further comprising a current source selectively connectable to the switching control circuit for adjusting a switching control circuit input.

6. The circuit according to claim 5, wherein the current source is coupled to the feedback circuit to adjust the switching control circuit input based an operational indication provided from the driver circuit to the feedback circuit.

7. The circuit according to claim 1, further comprising a parameter modulation control coupled to the switching control circuit for modulating an output of the switching control circuit to vary the signals provided to the driver circuit between a specified range.

8. The control circuit according to claim 7, wherein the parameter modulation circuit modifies a voltage input to the switching control circuit to be within 4.9 and 5.1 volts.

9. A control circuit for an electronic ballast with a power switch, comprising:

a driver circuit for driving the power switch;

a switching control circuit coupled to the driver circuit for providing signals to the driver circuit for operating the power switch;

a feedback circuit coupled to the driver circuit and the control circuit for providing control information to the control circuit based on output values of the driver circuit;

a fault responsive circuit coupled to the feedback circuit and the driver circuit for responding to faults detected in the feedback circuit;

the fault response circuit is operable to disable the driver circuit upon detection of a fault;

a fault criteria in the fault response circuit; and the fault criteria includes at least one of a crest factor indication and a zero volt switching indication.

10. A control circuit for an electronic ballast with a power switch, comprising:

a driver circuit for driving the power switch;

a switching control circuit coupled to the driver circuit for providing signals to the driver circuit for operating the power switch;

a feedback circuit coupled to the driver circuit and the control circuit for providing control information to the control circuit based on output values of the driver circuit;

a fault responsive circuit coupled to the feedback circuit and the driver circuit for responding to faults detected in the feedback circuit;

the fault response circuit is operable to disable the driver circuit upon detection of a fault;

a power input for supplying power to the control circuit; and a bootstrap diode coupled between the power input and the driver circuit to contribute to providing a start up voltage for the driver circuit.

11. A control circuit for an electronic ballast with a power switch, comprising:

a driver circuit for driving the power switch;

a switching control circuit coupled to the driver circuit for providing signals to the driver circuit for operating the power switch;

a feedback circuit coupled to the driver circuit and the control circuit for providing control information to the control circuit based on output values of the driver circuit;

a fault responsive circuit coupled to the feedback circuit and the driver circuit for responding to faults detected in the feedback circuit; and the fault response circuit is operable to disable the driver circuit upon detection of a fault;

wherein the feedback circuit is operable to process a signal from the driver circuit and influence the switching control circuit to obtain zero volt switching and minimum current switching for the switch.

12. An integrated circuit for driving a switching half bridge to supply power to a load, the circuit comprising:

a half bridge driver for supplying control signals to the half bridge;

a switching control circuit coupled to the half bridge driver for controlling the half bridge driver to supply signals to the half bridge;

a feedback circuit coupled to the half bridge driver and the switching control circuit to modify operation of the switching control circuit based on an operational value of at least one of the half bridge driver and the half bridge; and fault detection circuitry coupled to the half bridge driver and the feedback circuit for disabling outputs of the half bridge driver based on at least one of excessive current drawn by the load and non-zero volt switching in the half bridge.

13. The circuit according to claim 12, further comprising a current source coupled to an input of the switching control circuit and selectively controllable by the feedback circuit to influence operation of the switching control circuit.

14. The circuit according to claim 12, wherein the switching control circuit is a voltage controlled oscillator.

15. The circuit according to claim 12, further comprising a bootstrap diode coupled to the half bridge driver.

16. A circuit according to claim 12, further comprising a high voltage switch in the feedback circuit for sensing an output value of the half bridge driver.

17. The circuit according to claim 12, wherein the excessive current is determined as a peak current value being a multiple of an average current value for a specified period of time.

18. The circuit according to claim 12, further comprising adaptive control circuitry in the feedback circuit for influencing the switching control circuit to obtain zero volt switching and minimum current switching at the half bridge.

19. A method for controlling an electronic ballast to deliver power to a load, comprising:

driving a switching half bridge to supply power to the load;

sensing a half bridge operational parameter;

determining a feedback control based on the sensed parameter, the sensed parameter being provided by a feedback circuit coupled between a driver circuit and a switching control circuit of a ballast;

applying the feedback control to influence control of the half bridge; and determining whether a fault condition exists based on the sensed parameter.

20. The method according to claim 19, further comprising preventing the half bridge from being driven in the presence of a fault condition.

21. The method according to claim 19, further comprising modulating a parameter for driving the switching half bridge to decrease EMI noise emissions.

22. A method for controlling an electronic ballast including a switching half bridge during ignition of a lamp, comprising:

alternately switching switches in the half bridge at a high frequency at an initial stage;

decreasing the switching frequency toward a resonant load resonance frequency to increase current and voltage supplied to the lamp;

preventing the half bridge circuit from operating if there is at least one of a lamp ignition failure and an excessive load current; and maintaining the switching frequency near the resonant frequency after the lamp has ignited.

23. The method according to claim 22, further comprising operating a voltage controlled oscillator in conjunction with a half bridge driver to provide switching control signals to the switching half bridge.

24. The method according to claim 23, further comprising supplying a control voltage to the voltage controlled oscillator to adjust the switching frequency applied to the switching half bridge.

* * * * *